United States Patent [19]

Siebens

[11] 4,316,646

[45] Feb. 23, 1982

[54] LATERALLY FLEXIBLE ELECTRICAL CONNECTOR ASSEMBLY

[75] Inventor: Larry N. Siebens, Great Meadows, N.J.

[73] Assignee: Amerace Corporation, New York, N.Y.

[21] Appl. No.: 118,650

[22] Filed: Feb. 4, 1980

[51] Int. Cl.[3] ..... H01R 35/00

[52] U.S. Cl. ..... 339/7; 339/47 R; 339/100

[58] Field of Search ..... 339/6, 7, 47 R, 47 C, 339/10, 64 R, 64 M, 100

[56] References Cited

U.S. PATENT DOCUMENTS

| | | | |
|---|---|---|---|
| 2,519,933 | 8/1950 | Rouault | 339/7 X |
| 2,896,186 | 7/1959 | Hardmark | 339/100 |
| 2,999,998 | 9/1961 | Cole | 339/7 X |
| 3,459,873 | 8/1969 | Harris et al. | 339/7 X |
| 3,523,266 | 8/1970 | Wetzig et al. | 339/49 R X |
| 3,842,187 | 10/1974 | Barkan | 339/7 X |
| 3,989,400 | 11/1976 | Smith et al. | 339/100 X |
| 4,195,894 | 4/1980 | Kotsici | 339/75 A X |

*Primary Examiner*—Eugene F. Desmond
*Attorney, Agent, or Firm*—Arthur Jacob; David Teschner; Richard A. Craig

[57] ABSTRACT

An electrical connector assembly for selectively connecting sections of an electrical cable to establish a cable of desired longitudinal length suitable for use in underground mining operations includes a plurality of electrical connector elements, each connector element being provided with a pair of electrically and mechanically connectable components having a form analogous to a ball and socket coupling for imparting lateral flexibility to each connector element and to the connector assembly, while maintaining both the mechanical and the electrical integrity of the connector assembly. First connector elements of the connector assembly are employed to join supply conductors of one cable section to corresponding supply conductors of another cable section, while second connector elements of the connector assembly are employed to join a ground conductor of the one cable section to a corresponding ground conductor of the other cable section.

19 Claims, 12 Drawing Figures

LATERALLY FLEXIBLE ELECTRICAL CONNECTOR ASSEMBLY

The present invention relates generally to electrical connectors and connection systems and pertains, more particularly, to connector assemblies suitable for selectively joining sections of an electrical cable electrically and mechanically to establish a cable of desired length suitable for use in underground mining operations.

The art relating to electrical connector assemblies of the kind employed to join sections of an electrical power distribution cable employed with reels in underground mining operations is presently in a fairly active state of development. A significant reason for such development is a need to form on-site connections of the cable sections with connector assemblies which are of sufficient physical strength and flexibility to withstand, without failure, repetitive cycles of compression, tension, and bending forces exerted thereon from the action of operating equipment such as, for example, the mining reels. Moreover, in the interest of good engineering and safety, it is essential that such flexible assemblies be reliable electrically when subjected to electrical loads normally generated in underground mining operations, and that they be fabricated with a minimum number of parts and tooling to reduce material and production costs.

One solution to the above-outlined need is disclosed in U.S. Pat. No. 4,195,894 of Edward J. Kotski, granted Apr. 1, 1980, and assigned to the same assignee as the present application. In the assembly disclosed in said Kotski patent, corresponding individual conductors associated with each cable section to be joined together, including corresponding ground conductors, in one preferred form, are provided with connector elements in the form of pin-shaped male contacts and/or complementary pin-receiving socket-shaped female contacts secured to respective elongated load-sustaining members for mating with one-another. The load-sustaining member of each connector section is housed in an insulating sheath with two sheaths being complementary and engageable with one another in a transverse direction to form a connector assembly electrically and mechanically joining two cable sections together. The electrical connector assembly disclosed herein represents an alternate solution and differs from the solution offered by Kotski insofar as the instant assembly is provided with a completely unique structural arrangement and operation, which enables the provision of effective relief from the aforesaid forces during load conditions.

Accordingly, the present invention has as an object the provision of an improved electrical connector assembly having a plurality of connector elements therein with each connector element thereof being provided with a pair of components capable of being mated selectively and possessing a form analogous to a ball and socket coupling.

Another object of the invention is to provide an electrical connector assembly which enables the selective connection of sections of electrical cable to establish a cable of desired length, while assuring that the desired length of cable will retain a high degree of flexibility without impairing the operation of the connector assembly or the cable.

Still another object of the invention is to provide an electrical connector assembly of the type described, and which is relatively simple in construction, rendering the assembly economical to fabricate and install.

Yet another object of the invention is to provide an electrical connector assembly of the type described, and which is easy to use, enabling ease of connection and disconnection in the field.

A further object of the invention is to provide an electrical connector assembly of the type described, and which is rugged enough to withstand the rigors of the environment in which it is to be used so as to provide reliability over an extended useful service life.

In attaining the above objects, the invention contemplates an electrical connector assembly for use with a multiple conductor power distribution mining cable having several sections. The assembly comprises a plurality of connector elements of which there are two different types. Each one of the two types of connector elements is provided with a pair of components which selectively are connected to one another and disconnected both electrically and mechanically, the members having a form analogous to a ball and socket coupling. A first connector element of the assembly is utilized to join a supply conductor of one cable section to a corresponding supply conductor of another cable section, while a second connector element of the assembly is utilized to join a ground conductor of the one cable section to a corresponding ground conductor of the other cable section. The connection thus formed is of sufficient mechanical strength, flexibility, and electrical reliability to enable the assembled cable satisfactorily to perform its power distribution functions without failure, even though subjected to harmful forces of the type described above.

The invention will be understood more fully, while the foregoing and other objects and features of the invention will be further evident, from the following detailed description of a preferred embodiment of the invention illustrated in the accompanying drawing, in which:

FIG. 1 is a fragmentary plan view of a multiple conductor power distribution mining cable, partly in section, illustrating the manner in which an electrical connector assembly having therein first and second electrical connector elements connects two corresponding sections of the cable to one another, electrically and mechanically, all in accordance with the invention;

FIG. 2 is a fragmentary plan view of the cable of FIG. 1, partly in section, illustrating the manner in which first connector elements of the assembly electrically connect and mechanically couple corresponding supply conductors of the cable sections together in greater detail, and illustrating the manner in which a second connector element of the assembly electrically connects and mechanically couples corresponding ground conductors of the cable sections to one another in greater detail;

Figure 1:
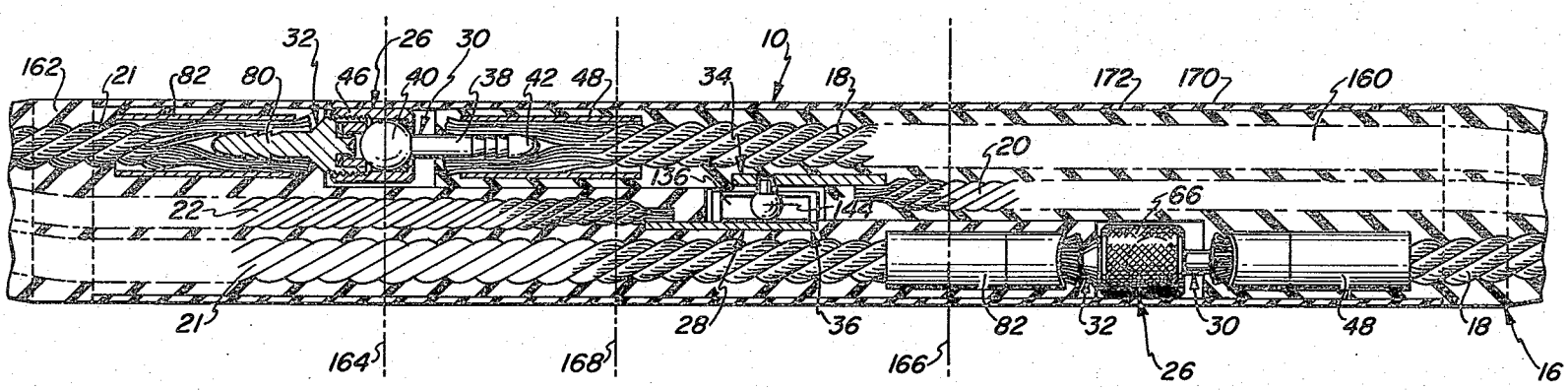
Figure 2:
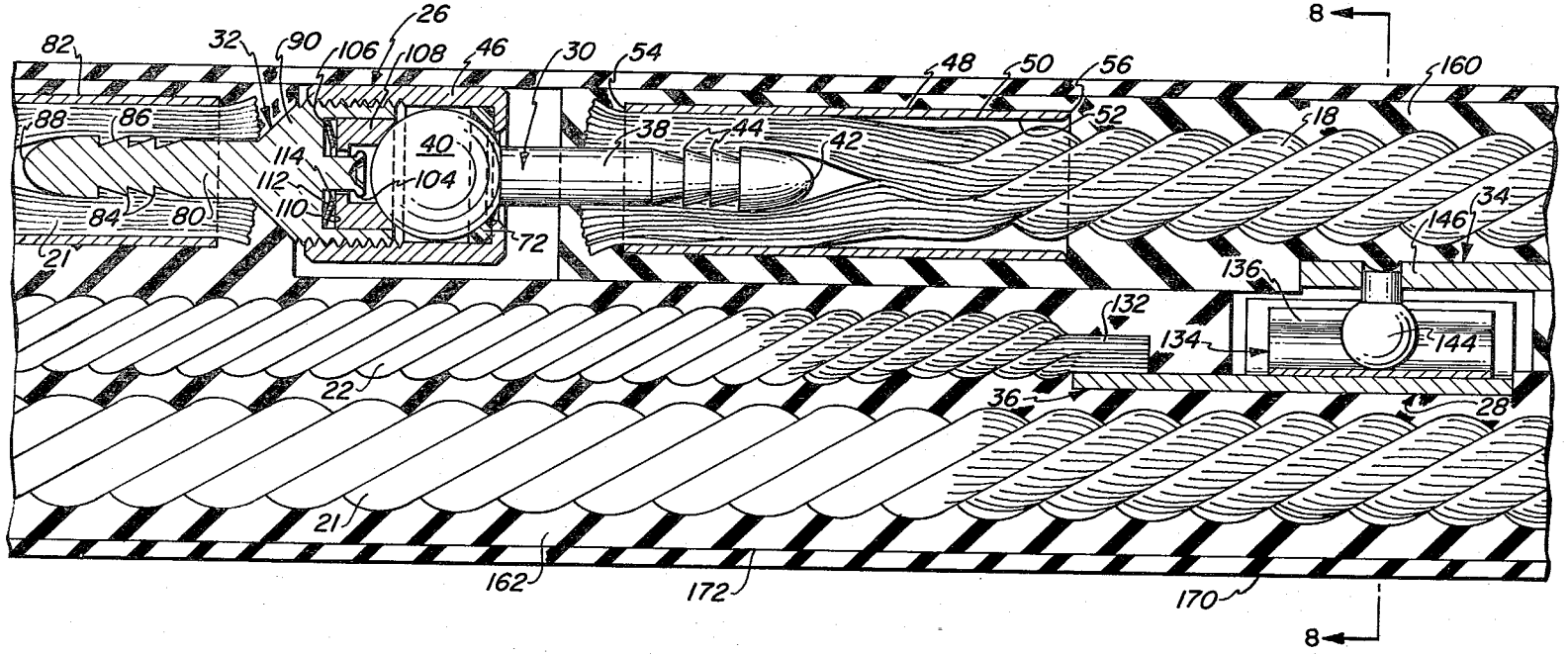

Referring now to the drawing, and especially to FIGS. 1 and 2, there is shown a preferred embodiment of an electrical connector assembly 10 of a type which enables fairly short cable sections 12 and 14 (see FIG. 11) of an electrical power distribution mining cable 16 to be connected selectively to establish an assembled cable of a desired length. For convenience in illustrating and disclosing the structure of connector assembly 10, a conventional multiple conductor mining cable 16 of a type having two multistrand insulated supply conductors and one multistrand insulated ground conductor has been selected. The two supply conductors of cable section 12 are designated by the common reference character 18 and the single ground conductor thereof is designated by the reference character 20. Similarly, the two supply conductors of the other cable section 14 are designated by the common reference character 21 and the single insulated ground conductor thereof is designated by the reference character 22. The conductors are provided with an insulating outer covering or cable jacket 24. Multiple conductor mining cables 16 defining several sections as described above often are utilized to distribute electrical power to mining apparatus positioned within mines beyond the limits of permanently wired power stations. By way of example, typical mining apparatus may include mine hoists, mine drills, mine ventilation fans, and vehicles for transporting coal, equipment, and mine workers, to name a few.

In the preferred arrangement, connector assembly 10 includes a plurality of electrical connector elements, with first connector elements 26 thereof being utilized to join together corresponding individual supply conductors 18 and 21 of corresponding cable section 12 and 14, and a second electrical connector element 28 thereof being utilized to join together corresponding ground conductors 20 and 22 of the corresponding cable sections 12 and 14, as will be explained more fully hereinafter. The first and second connector elements 26 and 28 are fabricated essentially from an electrically conductive material of sufficient strength to enable each element 26 and 28 to perform in a satisfactory manner, without failure, when subjected to mechanical forces and electrical loads typically associated with underground mining operations, as will become more readily apparent hereinafter. Each one of the first connector elements 26 includes first and second components 30 and 32 capable of selective connection to one another, both electrically and mechanically. Likewise, the second connector element 28 includes two electrically enagageable first and second components 34 and 36. Each of the above connector elements 26 and 28 has a configuration analogous to a ball and socket coupling, with the first components 30 and 34 serving generally as male electrical contacts and the second components 32 and 36 functioning generally as female electrical contacts.

Male component 30 of first connector element 26 has a generally elongate, fairly slender, cylindrically-shaped arm 38, which supports at one end thereof a fairly large spherically-shaped ball 40. The opposite end of arm 38 is provided with a conically-shaped tip 42. An intermediate portion of arm 38, between ball 40 and tip 42, is provided with a plurality of circumferentially extending sharp projections thereon in the form of annular ribs 44. Ribs 44 project radially outwardly from the outer surface of arm 38 so as to extend or point in a direction towards ball 40. By this structure, arm 38 is provided with a multiple-barbed surface adjacent tip end 42 thereof, which barbed surface resists retraction of arm 38 from supply conductor 18 after the arm is inserted therein, as will be explained more fully hereinafter.

Figure 3A:
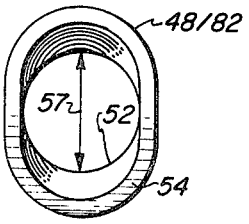
FIG. 3A is an end view of the flared end of the sleeve.
Figure 3:
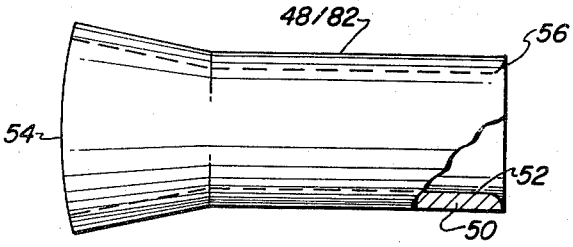
FIG. 3 is a plan view of a flared sleeve of the first connector element of FIG. 1.

Referring now to FIGS. 1 through 3 and 5 through 7, it will be observed that male component 30 of first connector element 26 is provided with a clamping or locking collar 46 and a flared sleeve 48, being disposed about opposite ends of arm 38. Flared sleeve 48 is in the form of an elongate hollow cylinder having a circumferentially extending wall 50, which wall 50 defines an axially extending opening 52 and two opposed circular ends 54 and 56. It is to be noted that sleeve 48 gradually increases in diameter from a smaller diameter at an intermediate portion located between the two opposite ends 54 and 56 to a larger diameter at end 54. By this configuration, end 54 is flared radially outwardly or spread open while the other end 56 is of a constant diameter, as best depicted in FIG. 3. The flare is limited, however, to directions parallel to one diameter 57, as seen in FIG. 3A, and does not extend to directions perpendicular to that one diameter 57, for reasons which will be explaind below. The inner diameter of opening 52 is of a suitable size to allow sleeve 48 to be disposed around a stripped terminal end of supply conductor 18 after arm 38 of male component 30 has been inserted longitudinally within an axially extending, central region of supply conductor 18, as best illustrated in FIGS. 1 and 2, and as will be explained more fully hereinafter.

Locking collar 46 is in the form of an elongate cylinder having opposed ends 58 and 60, one end thereof being open and the other being partially closed. An axially extending opening 62 is surrounded by a cylindrical wall 64. Wall 64 is provided with a knurled outer surface 66, as is best seen in FIG. 1, and a partially threaded inner surface having internal threads 68. Internal threads 68 extend from the open end 58 of collar 46 toward the partially closed end 60. Threads 68 are of a type suitable for engaging a threaded portion of female component 32, as will be explained more fully hereinafter. An unthreaded portion 70 of opening 62 adjacent partially closed end 60 has a reduced diameter. The unthreaded portion 70 defines a bearing surface for locating and seating a bearing ring 72 inserted therein, as will be described hereinbelow.

Bearing ring 72 preferably is fabricated from a synthetic resin material having some resiliency and a high degree of lubricity and is provided with opposed side surfaces 74 and 76 and an aperture 78 therein. Aperture 78 is of a suitable diameter to enable arm 38 to be inserted therethrough upon assembling locking collar 46 with male component 30. Side surface 74 is provided with a semi-spherical configuration complementary to the shape of the surface of ball 40 so as to enable a semi-spherical portion of the surface of ball 40 to be seated against surface 74. The opposite side surface 76 is generally flat and is complementary to a flat portion 77 of bearing surface 70 of locking collar 46, which flat portion 77 locates ring 72 within collar 46, when ring 72 is inserted within opening 62, as is best revealed in FIG. 2.

As best seen in FIGS. 1 and 2, each one of the two female components 32 of each one of the two first connector elements 26, upon comparison with each one of the two male components 30, includes an arm 80 and a flared sleeve 82 which are identical in structure and function to each arm 38 and each flared sleeve 48 of the two male components 30. Since the two flared sleeves 82 for female components 32 include substantially the same structure as the two flared sleeves 48 for male components 30, it is to be understood that a description of one will suffice for describing the other. However, since the only portions of the female components 32 substantially identical in structure and function to corresponding portions of the male components 30 are the arms 80 and flared sleeves 82, a description of the entire female component 32 will follow.

To that end, arm 80 of female component 32 has a plurality of circumferentially extending sharp projections thereon in the form of annular ribs 84. Ribs 84 project radially outwards from an external surface 86 of arm 80 in a direction away from a conically shaped tip 88 thereof, so as to provide arm 80 with a multiple-barbed surface which resists retraction of arm 80 from supply conductor 21 after the arm is inserted therein, as will be more fully explained hereinafter. Arm 80, opposite tip 88 thereof, is provided with a cylindrically-shaped socket 90.

Figure 4:
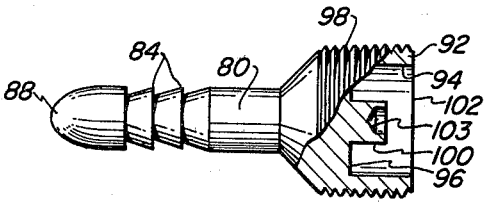
FIG. 4 is a side view, partly broken away, partly in section, of a female component member of the first connector element of FIG. 1.
Figure 7:
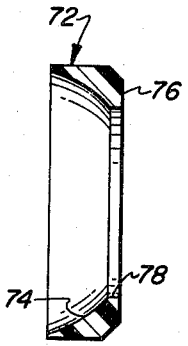
FIG. 7 is a longitudinal cross-sectional view of a bearing ring of the locking collar of FIG. 6.

Referring now to FIG. 4, as well as to FIGS. 1 through 3 and 5 through 7, socket 90 includes an axially-extending annular wall 92 which wall 92, in turn, defines an axially-extending recess 94 having base 96 therein. The outer surface of wall 92 is provided with external threads 98 of a size and type suitable for engaging the complementary threads 68 of locking collar 46 of connector element 26, as will be explained more fully hereinafter. The base 96 is provided with a cylindrical stem 100 projecting axially from a centrally located portion of base 96 towards open end 102 of recess 94. Open end 102 has a diameter of a suitable size for receiving therein a portion of ball 40 of male component 30. Stem 100 is recessed at 103 to enable permanent deformation of the stem to establish an outwardly flared retaining lip 104 at the tip of stem 100 for capturing a spring in the form of a spring washer 106 and a contact member in the form of a contact ring 108 within recess 94, as depicted in FIGS. 1 and 2.

As is best seen in FIG. 2, spring washer 106 has a generally frusto-conical configuration with opposed side surfaces 110 and 112 and an aperture 114. Washer 106 is of a suitable size to enable placement of the stem 100 for location of the washer adjacent base 96. Washer 106 is fabricated from a resiliently elastic material suitable for enabling washer 106 to provide positive electrical contact between ball 40 of male component 30 and contact ring 108 of female component 32, when the male component 30 and female component 32 of first connector element 26 are connected electrically and are subjected to bending and pulling forces produced under mechanical load conditions, as will be explained more fully hereinafter.

Figure 5:
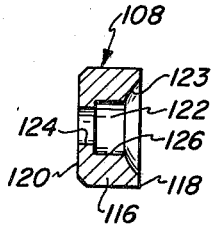
FIG. 5 is a longitudinal cross-sectional view of a contact ring member of the female component of FIG. 1.

As will be seen in FIG. 5, each contact ring 108 is in the form of a hollow cylinder having an axially extending wall 116, two opposed generally flat ends 118 and 120, and a central opening 122. The confines of opening 122 are provided with a geometrical configuration suitable for receiving therein a portion of ball 40 of male component 30 at end 118 thereof and for receiving stem 100 of female component 32 at the other end 120. Thus, a first portion 123 of opening 122 adjacent end 118 is provided with a semi-spherical configuration complementary to the surface shape of ball 40, while a second portion of opening 122 is provided with a cylindrical configuration complementary to the shape of stem 100. Still further, a portion 124 of the opening 122, immediately adjacent end 120, is provided with a diameter reduced in size relative to portion 126 thereof, located generally intermediate opposed ends 118 and 120, as FIG. 5 clearly illustrates. Upon sequentially placing spring washer 106 and contact ring 108 over stem 100, and the subsequent deformation of stem 100 to form flared lip 104, the above described geometric configuration of opening 122 allows flared retaining lip 104 of stem 100 to abutingly engage portion 126 of opening 122 so as to capture contact ring 108 and spring washer 106 within recess 94, as illustrated in FIG. 2.

Figure 8:
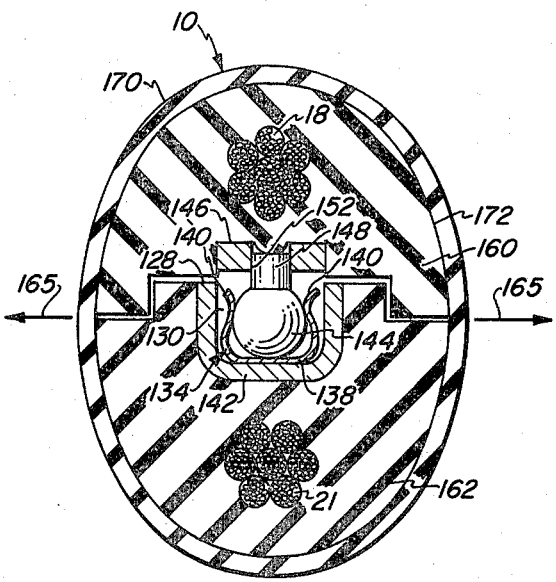
FIG. 8 is a transverse cross-sectional view of the mining cable and the second connector element of FIG. 2, taken along line 8—8 of FIG. 2.
Figure 6:
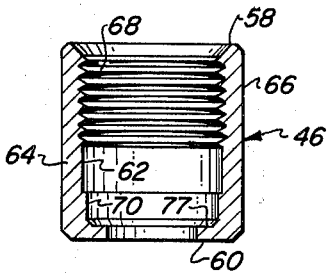
FIG. 6 is a longitudinal cross-sectional view of a locking collar of the female component of FIG. 1.
Figure 9:
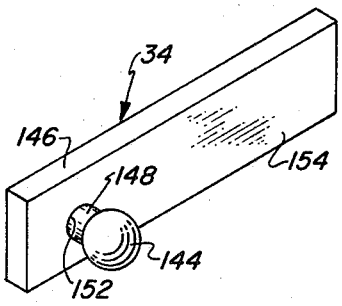
FIG. 9 is a perspective view of the male component of the second connector element of FIG. 1.
Figure 10:
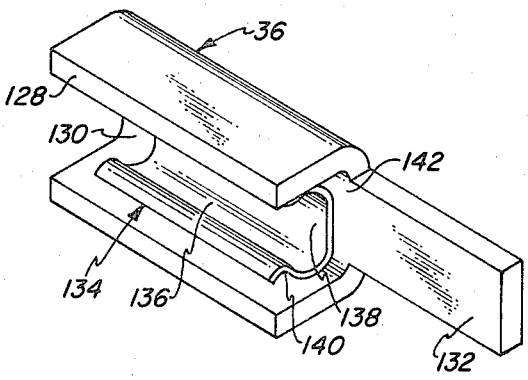
FIG. 10 is a perspective view of the female component of the second connector element of FIG. 1.

Referring now to FIGS. 8 through 10, as well as to FIGS. 1 and 2, female component 36 of second connector element 28 is provided with a socket 128 and an elongate, generally flat bar 132 integral therewith and which extends longitudinally from socket 128. The physical shape and form of bar 132 makes it especially suitable for connection to the stripped end of ground conductor 22, as is clearly shown in FIGS. 1 and 2. Socket 128 has an elongate, generally U-shaped channel 130. Channel 130 has an elongate, resiliently elastic clip 134 located therein.

Clip 134 is provided with a channel-shaped configuration complementary to the elongate channel-shaped configuration of socket 128, which configuration also provides clip 134 with an elongate recess 136. More specifically, recess 136 of clip 134 is defined by a planar bottom wall 138 and two inverted generally S-shaped flexible side walls 140 formed integral with bottom wall 138 and depending therefrom, as is best shown in FIGS. 8 and 10. Clip 134 is secured permanently within channel 130 of socket 128 by soldering bottom wall 138 to the bottom wall 142 or socket 128. The S-shaped side walls 140 provide clip 134 with a cross-sectional configuration complementary to a lateral projection in the shape of a ball-like element shown as ball 144 of male component 34, as seen in FIGS. 8 and 9. Moreover, walls 140 are sufficiently flexible and suitably spaced apart so as to allow recess 136 to receive ball 144 of male component 34 therein with a snapping or popping action. When so assembled, recess 136 and ball 144 form a connection analogous to a ball and socket arrangement while simultaneously allowing ball 144 to move slidingly in a longitudinal direction within recess 136, thereby also allowing linear longitudinal movement of male component 34 and female component 36 back and forth with respect to one another for the full longitudinal extent of recess 136, when second connector element 28 is under load conditions, as will be more fully explained hereinafter.

Referring now to male component 34 of the second connector element 28, an elongate essentially flat bar 146 carries ball 144 adjacent one end thereof. Ball 144 is coupled mechanically and electrically to bar 146 by a short shaft 148, which shaft 148 is integrally formed with ball 144 and is pressed fitted and secured, as by soldering, within an aperture 152 in bar 146 to establish the lateral projection which includes ball 144. The configuration of bar 146 provides a flat terminal surface 154 that is especially well-suited to the electrical connection of the ground conductors.

Figure 11:
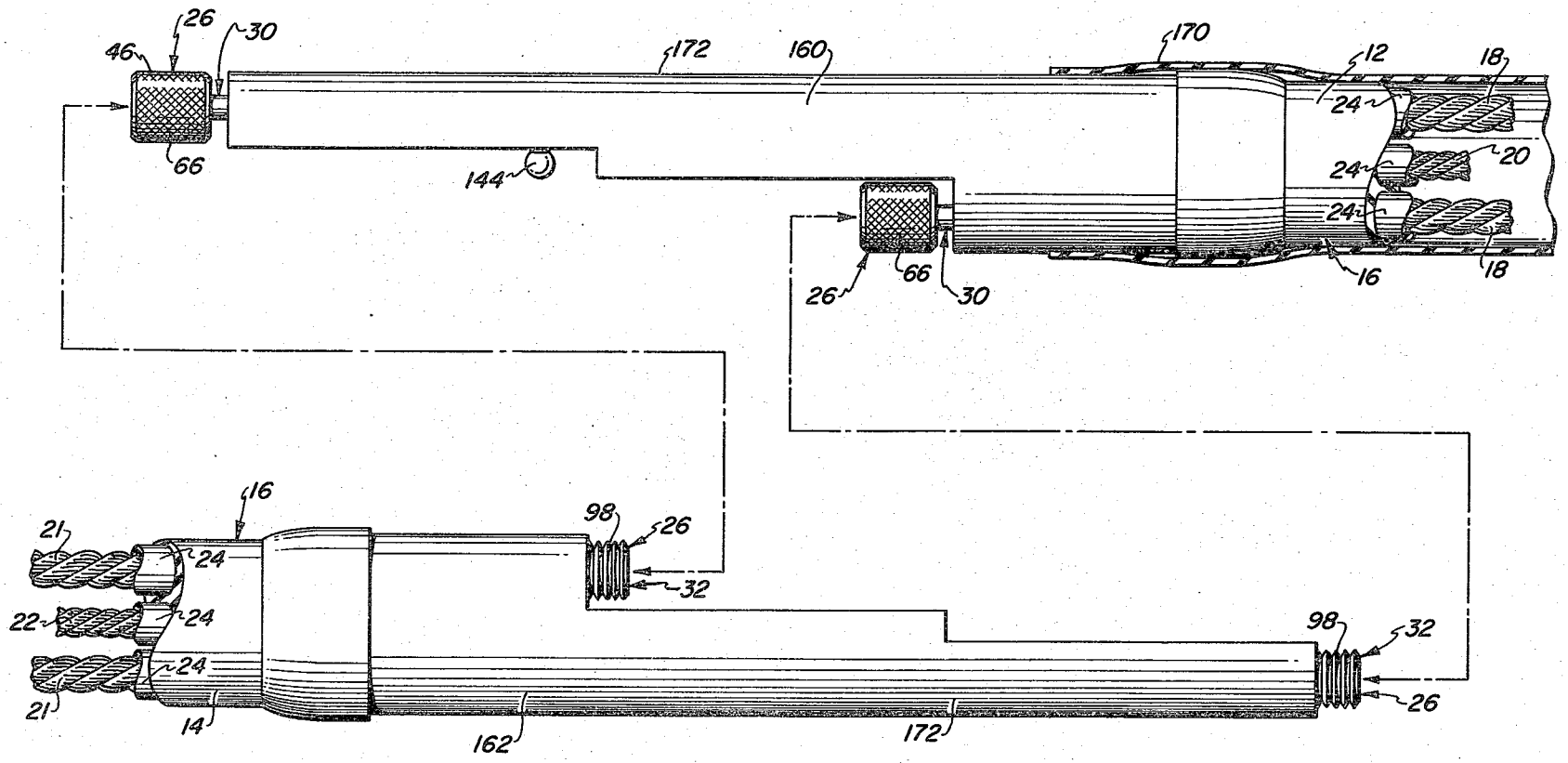
FIG. 11 is a plan view of the electrical connector with housing segments thereof disassembled.

A flexible connection is accomplished between cable sections 12 and 14 by installing a first housing segment 160 at the terminal end of cable section 12, installing a second housing segment 162 at the terminal end of cable section 14, as seen in FIG. 11, and then joining the housing segments 160 and 162 to establish the connector assembly 10, as seen in FIG. 1. The housing segments 160 and 162 are constructed of a flexible insulating elastomer and are installed by first stripping the terminal end region of each one of the two cable sections 12 and 14 of the outer jacket 24. The stripping operation exposes the insulated supply conductors 18 and 21 and the insulated ground conductors 20 and 22 within the cable section associated therewith, as is best seen in FIGS. 1 and 2. The exposed supply conductors 18 and 21 and the exposed ground conductors 20 and 22 are then also stripped of their insulation at their terminal ends to expose the stranded conductors thereof. The flared sleeves 48 are disposed over the corresponding stripped terminal ends of the supply conductors 18 and 21. When this operation is complete, it is to be noted that each flared sleeve 48 is oriented with its flared end 54 towards the stripped end of the respective supply conductor, as illustrated in FIGS. 1 and 2.

The locking collar 46 of connector element 26 is joined to male component 30 by first inserting bearing ring 72 within locking collar 46 and then inserting arm 38 of male component 30 through opening 62 in collar 46 until ball 40 is located within spherically-shaped side surface 74 of bearing ring 72. Upon being assembled in this fashion, arm 38 is disposed axially within a generally central, longitudinally extending length of the stripped terminal end of conductor 18 for essentially the full extent thereof. Arm 38, and thus male component 30, is permanently electrically and mechanically secured within supply conductor 18 by crimping and soldering flared sleeve 48, which is located over the terminal end of supply conductor 18 and juxtaposed with the multi-barbed surface of arm 38, to the strands of conductor 18. It will be appreciated that flared sleeve 48, when secured to supply conductor 18, exerts radial pressure around and on the multiple strands of supply conductor 18 within which ribs 44 of arm 38 are embedded. This enables the multi-barbed surface of arm 38 to bite into supply conductor 18 and through the strands thereof to resist axial retraction of male component 30.

Upon attaching each male component 30 to each supply conductor 18 of section 12, as described, the female component 32 of each first connector element 26 is then connected mechanically and electrically to each corresponding supply conductor 21 of the other section 14 utilizing arms 80 thereof and flared sleeves 82 in essentially the same manner that each male component 30 is attached to each supply conductor 18. It is noted that the aforesaid description of how ribs 44 of male component 30 and the flared sleeve 48 associated therewith resist axial retraction of male component 30 from supply conductor 18, applies as well to the description of how ribs 84 and the related flared sleeve 82 prevent axial retraction of female component 32 from supply conductor 18.

The component parts of second connector element 28 are affixed to the ground conductors 20 and 22 of sections 12 and 14 by soldering bar 146 of male component 34 to the stripped terminal end of ground conductor 20 and by soldering the bar 132 of female component 36 to the stripped terminal end of ground conductor 22.

Once the terminal ends of the cable sections 12 and 14 are so prepared, by affixing the various component parts of connector elements 26 and 28 to the conductors 18, 20, 21 and 22, as aforesaid, the housing segments 160 and 162 are molded, in the factory, over the terminal end of each respective cable section 12 and 14 to complete the installation.

In order to join the cable sections 12 and 14 in the field, housing segments 160 and 162 are assembled to establish connector assembly 10. The housing segments 160 and 162 merely are juxtaposed with one another, as indicated in FIG. 11, so that each connector element 26 and 28 can be connected. Thus, male component 30 and female component 32 of each first connector element 26, and hence supply conductors 18 and 21, selectively are connected electrically and are coupled mechanically to one another by threading locking collar 46 onto the threaded wall 92 of female socket 90. Selective disconnection is available by unthreading the threaded connections.

With female component 30 and male component 32 so coupled together and so connected between supply conductors 18 and 21, the physical structure of socket 90 and ball 40 allows the two components 30 and 32 to move with respect to one another by rotating substantially about an imaginary transverse axis 164 positioned approximately intermediate the tips 42 and 88 of the two joined components 30 and 32 when assembly 10 is subjected to bending forces. More specifically, under mechanical load conditions, socket 90 allows ball 40 to have rotary motion in every direction within limits defined by the confines of recess 94 and contact ring 108 within which ball 40 is seated. A load exerted on contact ring end 120 by spring washer 106 forces contact ring 108 against seated ball 40, thereby aiding female component 32 in maintaining positive electrical contact with male component 30 while ball 40 undergoes rotary motion. The aforesaid movement of male component 30 and female component 32 allows these components to provide the coupled supply conductors 18 and 21 with substantial stress relief from the aforesaid bending forces, thereby further allowing connector 26, and thus the coupled supply conductors 18 and 21, to perform satisfactorily the aforementioned functions and objectives for which they were intended, without failure. To this end, the radially outwardly flared configuration of sleeves 48 and 82 provide for the favorable distribution of mechanical stresses at the location of the flared end of each sleeve to reduce the likelihood of failure at those locations as a result of mechanical bending forces. It is noted that the cross-sectional configuration of connector assembly 10, as shown in FIG. 8, provides smaller radial dimensions in the directions indicated by arrows 165, thereby facilitating bending in those directions, while the larger radial dimensions in directions perpendicular to arrows 165 provide the capacity to accommodate the supply conductors 18 and 21, the ground conductors 20 and 22, and the related connector elements 26 and 28. The outwardly flared configuration of sleeves 48 and 82 thus is oriented so that the direction of the flare is aligned with the direction of the lateral flexing of the connector assembly 10 so as to perform the desired stress distribution function, but no flare is provided in the perpendicular directions, thereby enabling the dimensions of the connector assembly 10 to be kept to a minimum in those perpendicular directions.

Upon assembly of the housing segments 160 and 162 the male and female components 34 and 36 of second connector element 28, and thus ground conductors 20 and 22, are then separably connected electrically and mechanically coupled to one another by simply snapping ball 144 of male component 34 into recess 136 of female component 36.

With male component 34 and female component 36 so coupled and so connected between the two ground conductors 20 and 22, the physical structure of channel 130, including clip 134 therein, and ball 144, allows the two components 34 and 36 to move linearly in a longitudinal direction, back and forth with respect to one another when connector assembly 10 is subjected to tension and compression forces. It is noted that such forces are encountered frequently in an underground mining environment at load conditions and heretofore often have caused prior art connectors to fail. However, in the instant arrangement, the relative movement between male component 34 and female component 36 allows these components to relieve the coupled ground conductors 20 and 22 from harmful stresses which might otherwise be engendered by the aforesaid forces, thereby further allowing connector element 28, and thus the coupled ground conductors, to perform satisfactorily the aforementioned functions and objectives for which they were intended, without failure. In this connection, it is noted that the ground conductors 20 and 22 usually are smaller in diameter than the supply conductors 18 and 21. Hence, tensile loads are carried by the supply conductors 18 and 21 and the relatively strong connector elements 26, while connector element 28 relieves ground conductors 20 and 22 of tensile loads. Moreover, the structure of connector element 28, and the manner in which it is attached between sections 12 and 14, also enables the ground conductors 20 and 22 coupled therewith to flex or bend sufficiently about a pair of longitudinally spaced, laterally extending, imaginary axes 166 and 168. Axis 166 is located outboard of the bar 146 to which male component 34 is attached and axis 168 is located outboard of the bar 132 to which female component 36 is attached, as most clearly shown in FIG. 1. Further, the relative movement provided between the two components 34 and 36 of connector element 28 facilitates assembly and disassembly of housing segments 160 and 162 by allowing relative longitudinal movement of the housing segments during connection and disconnection of connector elements 26.

Upon assembly of the housing segments 160 and 162, as aforesaid, a tubular sheath 170 of elastomeric material is pulled over the assembled segments 160 and 162 and upon a recessed surface area 172 of the assembled segments 160 and 162 to seal the connection between the segments. Thus, the connection is sealed against water, oil, dirt and other deleterious matter found on the floor of a mine. Sheath 170 is resilient enough to be placed over one of the housing segments 160 and pulled back over the corresponding cable section 12, as illustrated in FIG. 11, and then subsequently pulled forward over the assembled housing segments 160 and 162 to complete the connector assembly 10.

It is noted that the two connector elements 26 are spaced longitudinally from one another, while connector element 28 is spaced longitudinally from each of the connector elements 26. The longitudinally staggered relationship of the connector elements 26 and 28 enables the housing segments 160 and 162 to remain relatively slender, thereby enhancing the lateral flexibility of connector assembly 10. At the same time, the staggered arrangement allows the connector elements 26 to be constructed in large enough dimensions to provide a rugged and serviceable coupling, without sacrificing flexibility and without reducing the integrity of the insulated connection provided by connector assembly 10.

Cable sections 12 and 14 selectively are disconnected by selective disassembly of housing segments 160 and 162 from one another. Such selective disassembly is accomplished merely by reversing the procedure described above for assembling the connection between cable sections. That is, sheath 170 is removed, either by pulling or cutting the sheath away from the housing segments 160 and 162, and then the connector elements 26 are disconnected to enable the housing segments to be disassembled.

Various changes and modifications to the particularly disclosed embodiment will be apparent to those skilled in the art and may be made without departing from the spirit of the invention. By way of example, the invention contemplates the use of as many first connector elements 26 as are needed to connect electrically all of the corresponding ones of the supply conductors defined by a given multiple conductor cable, as well as the use of as many second connector elements 28 as are needed to connect electrically all of the corresponding ones of ground conductors of the given cable. Moreover, in electrical applications where a ground conductor is not required, assembly 10 may include only a desired number of first connector elements 26 therein. These, as well as other alternatives, are considered to be within the scope of the present invention.

The embodiments of the invention in which an exclusive property or privilege is claimed are defined as follows:

1. An electrical connector assembly for selectively connecting consecutive sections of a power cable to produce an assembled cable of a desired longitudinal length and enabling selective disconnection of the cable sections, the cable sections each having a plurality of conductors including at least one supply conductor and at least one ground conductor, said electrical connector assembly comprising:

a plurality of connector elements corresponding to the plurality of conductors, said connector elements being spaced longitudinally from one another, each of said connector elements having electrically connectable first and second components thereof, each one of said first and second components having a first end and a second end;

securing means at the first end of each first component for electrically connecting and mechanically securing each first component to a conductor of one of said cable sections, and further securing means at the first end of each second component for electrically connecting and mechanically securing each second component to a corresponding conductor of another of said cable sections; and complementary means at the second end of each first component and at the second end of each second component for enabling selective mechanical and electrical connection and disconnection of the second ends to and from one another, said complementary means including relative motion means for enabling the first and second components to move relative to one another in response to lateral mechanical loads acting upon the connector element through the assembled cable when the first and second components are connected so as to enable lateral flexing of the assembled cable and the electrical connector assembly while maintaining the integrity of the electrical connection between said second ends and the integrity of the mechanical connection between connected consecutive cable sections.

2. The invention of claim 1 wherein:

said relative motion means includes complementary semi-spherical surfaces; and said complementary means includes coupling means for coupling the complementary semi-spherical surfaces in electrical contact with one another while permitting movement of the semi-spherical surfaces relative to one another about a lateral axis located intermediate the first ends of the connected first and second components.

3. The invention of claim 2 wherein:

said relative motion means includes a ball at the second end of the first component and a socket at the second end of the second component, said complementary semi-spherical surfaces being located on said ball and in said socket; and said coupling means includes retaining means selectively retaining the first component coupled with the second component with the ball seated within the socket.

4. The invention of claim 3 including resilient means resiliently biasing the semi-spherical surfaces toward one another when the first component is coupled with the second component.

5. The invention of claim 4 wherein the socket includes a recess;

an electrical contact member is located in the recess and carries one of the semi-spherical surfaces;

the resilient means includes a spring in the recess, said spring engaging the contact member to bias the contact member toward the ball; and means are located in the socket for capturing the electrical contact within the socket.

6. The invention of claim 3, 4 or 5 wherein the coupling means includes:

a locking collar carried by the first component and having a first thread thereon; and a second thread on the second component and complementary with the first thread;

the first and second threads being selectively engageable to couple mechanically the first component and the second component with the semi-spherical surfaces engaged in electrical connection with one another.

7. An electrical connector assembly for selectively connecting consecutive sections of a power cable to produce an assembled cable of a desired longitudinal length and enabling selective disconnection of the cable sections, the cable sections each including at least one conductor, said electrical connector assembly comprising:

at least one connector element, said connector element having electrically connectable first and second components thereof, each one of said first and second components having a first end and a second end;

securing means at the first end of the first component for electrically connecting and mechanically securing the first component to a conductor of one of said cable sections, and further securing means at the first end of the second component for electrically connecting and mechanically securing the second component to a corresponding conductor of another of said cable sections; and complementary means at the second end of the first component and at the second end of the second component for enabling selective mechanical and electrical connection and disconnection of the second ends to and from one another, said complementary means including relative motion means for enabling the first and second components to move relative to one another in response to lateral mechanical loads acting upon the connector element through the assembled cable when the first and second components are connected so as to enable lateral flexing of the assembled cable and the electrical connector assembly while maintaining the integrity of the electrical connection between said second ends and the integrity of the mechanical connection between connected consecutive cable sections, said relative motion means including a lateral projection adjacent the second end of the first component, said lateral projection including a semi-spherical surface; and an elongate longitudinal recess adjacent the second end of the second component, said recess having a lateral cross-sectional configuration complementary to the semi-spherical surface of the lateral projection for capturing the projection therein while enabling longitudinal movement of the projection within the recess.

8. The invention of claim 7 wherein the relative motion means includes a spring clip, said elongate recess being located within the spring clip, and the lateral projection comprises a ball-like element for being captured within the recess of the spring clip for sliding movement within the recess and along the spring clip.

9. The invention of claim 8 wherein the securing means includes a first bar adjacent the first end of the first component and the further securing means includes a second bar adjacent the first end of the second component, each said first and second bar being capable of securement to the terminal end of a corresponding cable conductor.

10. The invention of claim 1, 2, 3, 4 or 5 wherein the securing means and the further securing means each includes a multiple-barbed surface adjacent the first end of each of the first and second components for resisting retraction of each said component from the corresponding conductor to which the component is secured.

11. The invention of claim 10 wherein the securing means and further securing means each further includes a sleeve placed over each conductor and juxtaposed with the multiple-barbed surface of the first end of the corresponding component so as to further secure the component to the conductor.

12. An electrical connector assembly for selectively connecting consecutive sections of a power cable to produce an assembled cable of a desired longitudinal length and enabling selective disconnection of the cable sections, the cable sections each including at least one conductor, said electrical connector assembly comprising:

at least one connector element, said connector element having electrically connectable first and second components thereof, each one of said first and second components having a first end and a second end;

securing means at the first end of the first component for electrically connecting and mechanically securing the first component to a conductor of one of said cable sections, and further securing means at the first end of the second component for electrically connecting and mechanically securing the second component to a corresponding conductor of another of said cable sections; and complementary means at the second end of the first component and at the second end of the second component for enabling selective mechanical and electrical connection and disconnection of the second ends to and from one another, said complementary means including relative motion means for enabling the first and second components to move relative to one another in response to lateral mechanical loads acting upon the connector element through the assembled cable when the first and second components are connected so as to enable lateral flexing of the assembled cable and the electrical connector assembly while maintaining the integrity of the electrical connection between said second ends and the integrity of the mechanical connection between connected consecutive cable sections;

the securing means and the further securing means each including a multiple-barbed surface adjacent the first end of each of the first and second components for resisting retraction of each said component from the corresponding conductor to which the component is secured, and a sleeve placed over each conductor and juxtaposed with the multiple-barbed surface of the first end of the corresponding component so as to further secure the component to the conductor, each sleeve including a radially outwardly flared configuration adjacent the terminal end of the conductor upon which the sleeve is located, said flared configuration extending in the direction of said lateral flexing for the favorable distribution of stresses arising in response to said lateral flexing.

13. An electrical connector assembly for selectively connecting consecutive sections of a power cable to produce an assembled cable of a desired longitudinal length and enabling selective disconnection of the cable sections, the cable sections each having a plurality of conductors including at least one supply conductor and at least one ground conductor, said electrical connector assembly comprising:

a plurality of connector elements corresponding to the plurality of conductors, said connector elements each having electrically connectable first and second components thereof, each one of said first and second components having a first end and a second end;

securing means at the first end of each first component for electrically connecting and mechanically securing each first component to a conductor of one of said cable sections, and further securing means at the first end of each second component for electrically connecting and mechanically securing each second component to a corresponding conductor of another of said cable sections; and complementary means at the second end of each first component and at the second end of each second component for enabling selective mechanical and electrical connection and disconnection of the second ends to and from one another, said complementary means including relative motion means for enabling the first and second components to move relative to one another in response to lateral mechanical loads acting upon the connector element through the assembled cable when the first and second components are connected so as to enable lateral flexing of the assembled cable and the electrical connector assembly while maintaining the integrity of the electrical connection between said second ends and the integrity of the mechanical connection between connected consecutive cable sections, the relative motion means of at least one of said plurality of connector elements including complementary semi-spherical surfaces; and said complementary means includes coupling means for coupling the complementary semi-spherical surfaces in electrical contact with one another while permitting movement of the semi-spherical surfaces relative to one another about a lateral axis located intermediate the first ends of the connected first and second components; and the relative motion means of at least another of the plurality of connector elements includes:

a lateral projection adjacent the second end of the first component of said another of the plurality of connector elements, said lateral projection including a semi-spherical surface; and an elongate longitudinal recess adjacent the second end of the second component of said another of the plurality of connector elements, said recess having a lateral cross-sectional configuration complementary to the semi-spherical surface of the lateral projection for capturing the projection therein while enabling longitudinal movement of the projection within the recess.

14. The invention of claim 13 wherein:

the securing means and further securing means of said one of the plurality of connector elements includes a multiple-barbed surface adjacent the first end of each of the first and second components for resisting retraction of each said component from the corresponding conductor to which the component is secured; and the securing means and further securing means of said another of the plurality of connector elements includes a first bar adjacent the first end of the first component thereof and the further securing means includes a second bar adjacent the first end of the second component thereof, each said first and second bars being capable of securement to the terminal end of a corresponding cable conductor.

15. The invention of claim 14 wherein the securing means and further securing means of said one of the plurality of connector elements further includes a sleeve placed over each conductor and juxtaposed with the multiple-barbed surface of the first end of the corresponding component so as to further secure the component to the conductor.

16. The invention of claim 15 wherein each sleeve includes a radially outwardly flared configuration adjacent the terminal end of the conductor upon which the sleeve is located, said flared configuration extending in the direction of said lateral flexing for the favorable distribution of stresses arising in response to said lateral mechanical loads.

17. The invention of claim 13, 14, 15 or 16 wherein the plurality of connector elements are spaced longitudinally from one another.

18. The invention of claim 17 wherein:

the securing means and further securing means of said one of the plurality of connector elements are for securing the components of that connector element to corresponding supply conductors; and the securing means and further securing means of said another of the plurality of connector elements are for securing the components of said another connector element to corresponding ground conductors.

19. The invention of claim 18 including first and second selectively assembled housing segments, the second end of each first component being located in one of said housing segments and the second end of each second component being located in the other of said housing segments.

* * * * *